United States Patent [19]

Holzbaur et al.

[11] 4,064,847

[45] Dec. 27, 1977

[54] FUEL INJECTION SYSTEM FOR INTERNAL COMBUSTION ENGINES

[75] Inventors: Siegfried Holzbaur, Stuttgart; Horst Barth, Asperg, both of Germany

[73] Assignee: Robert Bosch GmbH, Stuttgart, Germany

[21] Appl. No.: 730,615

[22] Filed: Oct. 7, 1976

[30] Foreign Application Priority Data

Oct. 17, 1975 Germany ..... 2546560

[51] Int. Cl.[2] ..... F02B 3/12

[52] U.S. Cl. ..... 123/32 EJ; 123/119 R; 123/139 BG; 123/139 AW; 123/139 AT; 123/139 BC; 261/44 A; 261/44 R

[58] Field of Search ..... 261/44 A, 44 R, 50 A, 261/62; 123/119 R, 139 BG, 139 AW, 32 EJ, 139 AT, 139 BC

[56] References Cited

U.S. PATENT DOCUMENTS

| | | | |
|---|---|---|---|
| 110,651 | 11/1917 | Dillon-Grand | 261/44 A |
| 1,555,489 | 9/1925 | Spencer et al. | 261/44 R |
| 3,711,068 | 1/1973 | Perry | 261/44 A |
| 3,777,725 | 12/1973 | Stumpp et al. | 123/119 R |
| 3,880,125 | 4/1975 | Kammerer et al. | 123/32 EJ |

*Primary Examiner*—Charles J. Myhre
*Assistant Examiner*—R. Nelli
*Attorney, Agent, or Firm*—Edwin E. Greigg

[57] ABSTRACT

A fuel injection system for internal combustion engines in which fuel is metered out on the basis of the relative rotation of an air flow rate metering flap in the induction tube to a location upstream of the throttle valve. In order to prevent fuel condensation on the throttle valve during engine idling, the idling fuel quantity is delivered to a separate point in the induction tube lying downstream of the throttle valve.

14 Claims, 4 Drawing Figures

FUEL INJECTION SYSTEM FOR INTERNAL COMBUSTION ENGINES

BACKGROUND OF THE INVENTION

The invention relates to a fuel injection system for externally ignited internal combustion engines which includes as air flow metering mechanism. The air flow meter controls a fuel metering system which has a fuel injection orifice located within the induction tube upstream of a throttle valve that is actuated arbitrarily.

In injection systems of this type, it is difficult to obtain a satisfactory mixture preparation, especially in the domain of engine idling, among other things, of fuel condensation, which occurs on the throttle valve that is located between the injection orifice and the inlet to the engine.

In order to overcome this difficulty, a known fuel injection system provides a heater element for heating the throttle valve so as to prevent fuel condensation thereon.

OBJECT AND SUMMARY OF THE INVENTION

It is a principal object of the invention to provide a fuel injection system of the general type described above which is not subject to the above-mentioned disadvantages during engine idling.

This object is attained according to the invention by providing that the fuel or the fuel-air mixture needed for engine idling is delivered to the induction tube in a region lying downstream of the throttle valve as seen in the direction of the air flow.

This provision prevents the condensation of fuel on the throttle valve at idling speeds, such condensation is particularly troublesome because the low air speed does not permit its re-evaporation. Thus, when the engine is later accelerated, the then occurring evaporation enriches the fuel-air mixture beyond the proper degree and causes irregular running and missing of the engine. These disadvantages are prevented by the apparatus according to the invention.

The invention will be better understood as well as further objects and advantages thereof become more apparent from the ensuing detailed specification of four exemplary embodiments taken in conjunction with the drawing.

DESCRIPTION OF THE PREFERRED EMBODIMENTS

Figure 1:
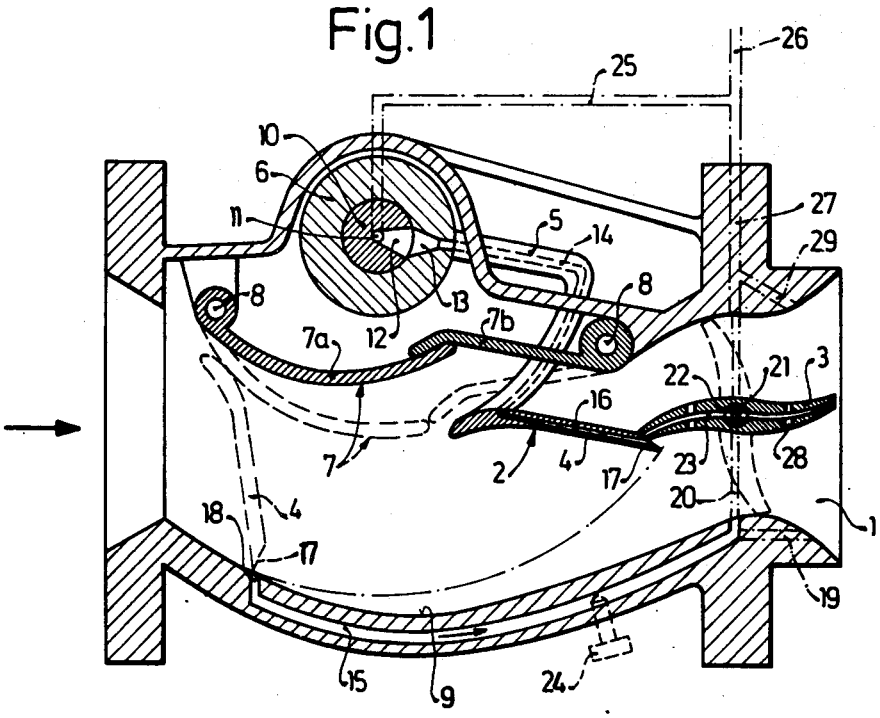
FIG. 1 is a sectional axial view of a fuel injection system according to the invention.

Turning now to FIG. 1, there is illustrated an air induction tube region 1 which includes an air flow rate meter 2 and a throttle valve 3. The air flow rate meter 2 has a flap 4 which is exposed to the air aspirated by the engine and which is connected by a bridge 5 to a valve bushing 6. The degree of rotation of the valve bushing 6 is used as a parameter for determining the amount of fuel metered out to the engine. The fuel injection process itself may take place at some location in the vicinity of the metering, for example at the air flap 4, or in some location in the induction tube or adjacent to the inlet valves of the engine.

When the air flap 4 occupies the position shown in broken lines in FIG. 1 (which corresponds to the broken-line position of the throttle valve 3), it substantially obturates the entire air passage and thus acts as a baffle plate operating by the laws of the resistance principle, whereas, when the air flow rate increases, due to the position of the throttle valve 3 and/or the engine rpm, the flap 4 may be displaced up to its nearly horizontal position shown in solid lines. In this position, which corresponds to a maximum air flow rate, the flap 4 is subject to lift due to its action as an air foil. Air flows around the flap 4 on both sides and it is desirable if the bridge 5 has an aerodynamic profile so as to present a minimum resistance to the air flow.

The degree of displacement of the flap 4 and hence the amount of metered out fuel also depends on the flow cross section, defined by the flap 4 on the one hand and by the induction tube wall on the other hand. The induction tube wall is so shaped that the flow cross section changes linearly with the pivotal motion of the flap 4, i.e., the fuel quantity increases linearly with the air flow rate. However, it may be desirable, for example, to enrich the fuel-air mixture by admitting more fuel at some particular value of the air flow rate; for this purpose, the flow cross section must be reduced so that, for the same air flow rate, the flap experiences a greater displacement and thus more fuel may be metered out through the valve 6. This object is attained by a substantially lateral displacement of a wall portion 7 of the induction tube lying between the flap 4 and the valve bushing 6 in the direction of the flap 4. For this purpose, the wall may be divided into two pivotal regions 7*a* and 7*b* or it may be embodied as a single member pivoting about an appropriate axis. For example, if, as shown, the wall 7 assumes the position shown in dashed lines, the flow cross section available to the air flow is that between the flap 4 and the opposite induction tube wall 9. If, for example, that cross section is chosen to be half as great as the previously available flow cross section, then the quantity of fuel provided for a given air flow rate would be twice as large. It would be entirely suitable to make the wall 9 movable instead of, or in addition to, the wall portion 7. The displacement of the wall members 7*a*, 7*b* on their shafts 8 may take place in dependence on air pressure, on engine temperature, or some other parameter, for example the exhaust gas composition, in any suitable manner not further illustrated.

The valve bushing 6 is mounted on a locally fixed shaft 10 which has a central bore 11 for receiving and distributing fuel. The fuel metering takes place by the action of grooves 12 and 13, respectively disposed in the shaft 10 and the bushing 6, which overlap to a varying degree depending on the mutal angular position of the shaft 10 and the bushing 6. In the position illustrated in FIG. 1, the two grooves 12 and 13 have attained their maximum degree of overlap, corresponding to the maximum air flow and the maximum displacement of the air flap 4. A channel 14, disposed within the bridge 5, provides fluid communication between the groove 13 and, preferably several lengthwise channels 16 within the flap 4 provided with nozzles 17. The nozzles 17 are preferably disposed in the edge region of the flap 4 and deliver fuel upstream of the throttle valve 3 into the induction tube 1. As previously explained, it is an object of the invention to provide fuel downstream of the throttle valve 3 during engine idling. For this purpose, there is provided within the induction tube region 1 a bypass channel 15 having an inlet 18 which, in the idling position of the air flap 4 which is illustrated in broken lines, lies directly opposite the injection nozzle 17 within the air flap 4 so that the idling fuel quantity is delivered directly into the bypass 15. The terminus of the bypass 15 is an induction tube region lying downstream of the throttle valve so that the vacuum prevailing there tends to aspirate fuel and air from the bypass 15 to the engine and fuel does not impinge on the surface of the throttle valve 3.

Alternatively, there could be provided a channel 20 connected to a central bore 21 within the shaft 22 of the throttle valve, preferably terminating at its edges. It is known that the air velocity near the edges of the throttle valve is highest, resulting in an especially favorable degree of fuel preparation. The connection line from the bypass 15 to the bore 21 may be so embodied that, when the throttle valve is in its idling position, there is an open communication, whereas in other positions of the throttle valve 3, the communication is blocked.

Preferably, the flow cross section of the bypass 15 may be adjusted by means of a throttle screw 24.

In a variant of the invention, the idling fuel quantity may be delivered directly to the bore 21 or to the region downstream of the throttle valve 3. Thus, there may be provided a channel 25 shown in dash-dot lines, leading directly from the internal fuel bore 11 of the shaft 10 to the induction tube or, again, there may be provided a channel 26 leading directly from the fuel pump to the induction tube through a channel 27. Thus feel may be added over the entire rpm domain of the engine or, alternatively, a suitable mechanism located between the channel 27 and the bore 21 may shut off the supply of idling fuel when the throttle valve 3 is rotated into positions of greater power and load.

In the case that idling fuel is added at all times and during the entire rpm domain of the engine, it is suitable to provide within the throttle flap 3 transverse bores 28 which cross the channels 23 and through which air may pass in certain positions of the throttle valve 3, especially the position shown, thereby inducing the transport of fuel and providing a soft transition between the idling operation and the operation at low load. In the position of the throttle valve 3 shown in dashed lines, the nozzles located at the edges of the valve are blocked by the induction tube wall so that fuel flows entirely through the bores 28 and experiences good atomization without impinging directly on any portions of the induction tube. If the throttle valve is opened slightly during low load operation, the nozzles at the edge of the throttle valves are gradually opened so that fuel begins to flow through the nozzles and no longer emerges from the bores 28. This favorable and smooth transition between the two manners of delivering fuel prevents rough engine operation or unfavorable changes in the exhaust gas composition.

Figure 2:
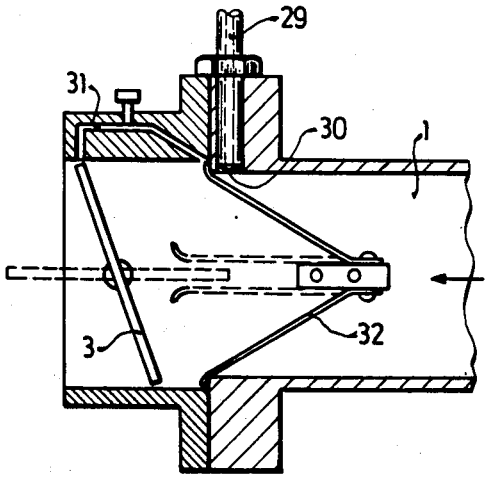
FIG. 2 is a sectional view of a second embodiment of the apparatus according to the invention.

FIG. 2 illustrates an exemplary embodiment of the invention in which the fuel is delivered through a channel 29 in FIG. 1. The idling fuel quantity is fed through the channel 29 and a nozzle 30 into the induction tube 1. At idling rpm, the throttle valve 3 is closed so that the fuel flows through a bypass 31 into the induction tube at the side adjacent the downstream edge of the throttle valve. At higher rpm, when the throttle valve 3 begins to open, the fuel is instead sprayed onto the end of a guide foil 32 which yields under the influence of the air current to assume the position shown in dashed lines, resulting in a very favorable fuel preparation due to the fact that the air velocity at the bent end of the guide foil 32 is highest.

Figure 3:
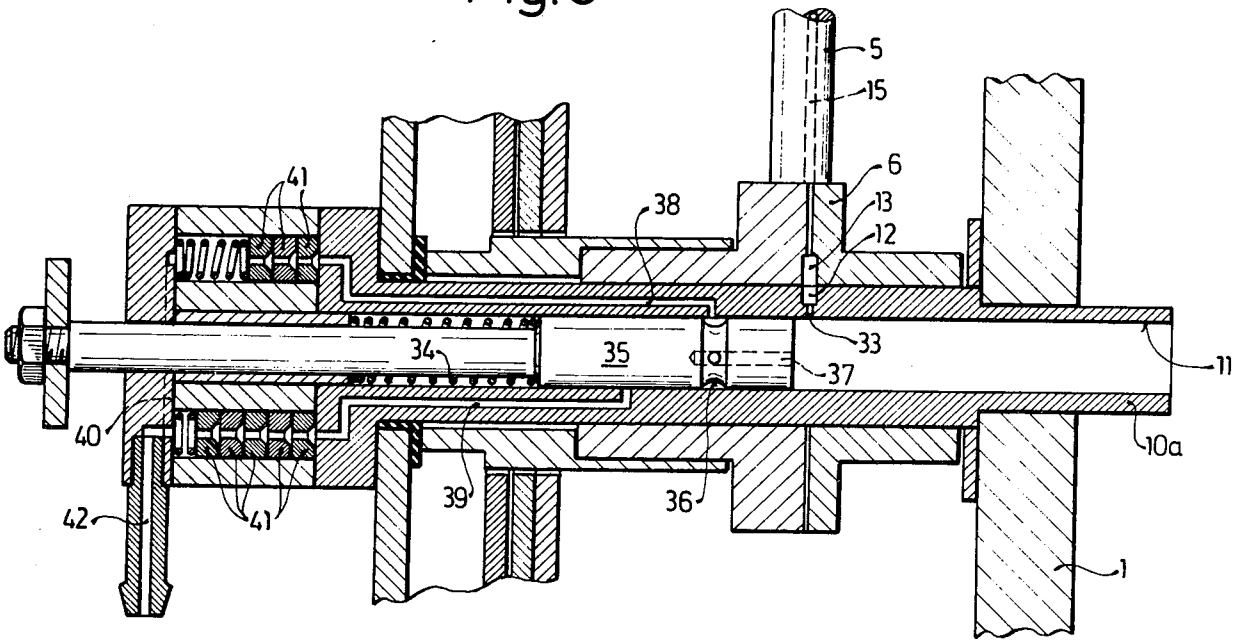
FIG. 3 is a sectional diagram of a further exemplary embodiment of the invention.

The manner in which the idling fuel quantity is actually metered out by the mechanism of the air flap hinge and during normal fuel metering will now be discussed with the aid of FIG. 3. As shown there, the shaft 10*a* of the air valve 4 is mounted in the walls of the induction tube 1 and carries the bushing 6 and the bridge 5. The main fuel quantity is metered out by the cooperation of grooves 12 and 13, the former communicating through a bore 33 with the fuel supply line 11 in the shaft 10*a* whereas the latter communicates with the channel 15 in the bridge 5. The bore 11 includes an axially movable control piston 35 loaded by a spring 34 and carrying an annular groove 36 which communicates via a channel 37 with the fuel chamber 11. Depending on the axial position of the piston 35, the annular groove 36 opens up a channel 38 or a channel 39 provided within the wall of the shaft 10*a*. In certain positions, the flow may be stopped through both channels 38 and 39. Fuel flowing through these channels is collected in an annular conduit 40 and delivered through a hose nipple 42 to a hose, not shown, which is connected to the throttle valve or to the induction tube region downstream of the throttle valve. In the example illustrated, the channel 38 has a fewer number of throttles 41 than has the channel 39. If, for example, the slide 35 is displaced by means of a thermostat, the idling fuel quantity may be delivered to the channel 38 when the engine is cold and through the channel 39 when the engine is warmed up. Since the channel 39 includes a larger number of throttles 41, the idling fuel quantity delivered therethrough is smaller than that delivered through the channel 38. Thus, the cold engine receives more fuel than the warm engine. The transition from low to high fuel quantity may also be effected in a continuous manner by known means.

Figure 4:
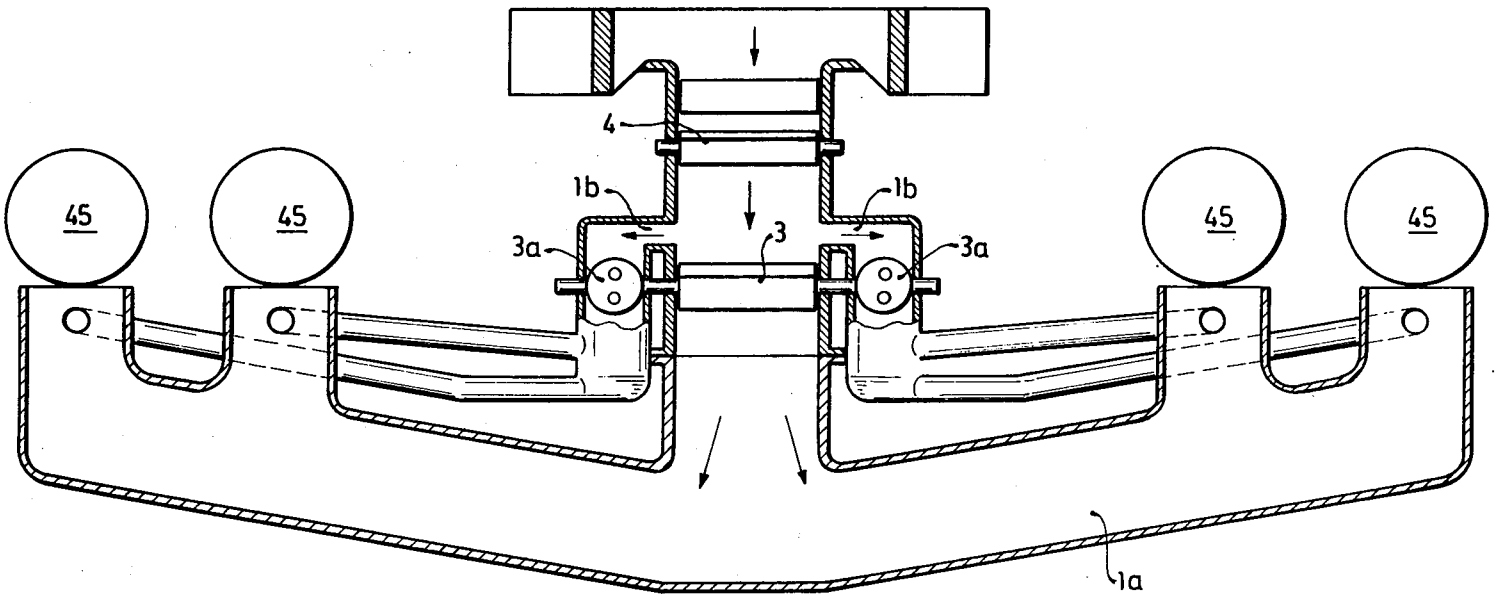
FIG. 4 is a diagram of a fourth exemplary embodiment of the invention.

In another exemplary embodiment of the invention, illustrated in FIG. 4, there is shown an induction tube manifold region 1*a* supplying four cylinders of an internal combustion engine. The induction tube 1*a* has regions 1*b* of smaller diameter than the main tube which branch off between the throttle valve 3 and the air flap 4 and which contain additional throttle valves 3*a* which are actuated in unison with the main throttle valve 3 so that the air flow through the smaller tubes 1*b* is coordinated in a desired ratio with the main air flow rate. The smaller induction tube sections 1*b* re-connect with the main induction tube just ahead of the intake valves of the individual engine cylinders 45. The idling fuel quantity may be metered out and delivered in the manner previously described but directly downstream of the secondary throttle valves 3*a* in the smaller induction tube sections 1*b*. Thus, the idling mixture is admitted directly to the engine cylinders 45, thereby insuring a very favorable and smooth idling.

The foregoing relates to preferred embodiments of the invention, it being understood that other embodiments and variants are possible within the spirit and scope of the invention, the latter being defined by the appended claims.

What is claimed is:

1. A fuel injection system for internal combustion engines, including means for injecting fuel into the air induction tube of the engine at a location upstream of the main throttle valve, the improvement comprising means for delivering a quantity of fuel for engine idling to a location in said induction tube lying downstream of the said main throttle valve.

2. A fuel injection system as defined by claim 1, the improvement further comprising air flow metering means including a pivotable flap disposed in said induction tube and means for providing a restoring force to oppose the force of the air flow on said flap; whereby the pivotal motion of said flap is representative of the magnitude of the air flow rate through said induction tube.

3. A fuel injection system as defined by claim 2, wherein said means for measuring the air flow rate includes a rotary valve bushing having a first metering aperture rotating with respect to a fixed member having a second metering aperture, whereby the relative overlap of said first and second apertures defines the metered out fuel quantity and further including means for delivering an additional idling fuel quantity; whereby said idling fuel quantity is the minimum metered out fuel quantity.

4. A fuel injection system as defined by claim 3, including conduit means for delivering said idling fuel quantity continuously to the induction tube of the engine downstream of said throttle valve.

5. A fuel injection system as defined by claim 3, wherein said rotary bushing includes means for adjusting said idling fuel quantity, said adjustment means being operable pneumatically.

6. A fuel injection system as defined by claim 3, wherein said rotary bushing includes means for adjusting said idling fuel quantity, said adjustment means being operated by temperature dependent means.

7. A fuel injection system as defined by claim 1, comprising a bypass conduit connecting portions of the induction tube lying upstream of the main throttle valve to portions of the induction tube lying downstream of the throttle valve.

8. A fuel injection system as defined by claim 7, wherein the air flap is provided with nozzle means for delivering fuel to the interior of the induction tube and wherein said bypass conduit branches off from a location in the induction tube which is adjacent to said nozzle when said air flap is in its idling position; whereby, during engine idling, said nozzle delivers fuel into the inlet of said bypass conduit.

9. A fuel injection system as defined by claim 7, including means for changing the effective flow cross section in said bypass conduit.

10. A fuel injection system as defined by claim 1, wherein said main throttle valve includes an interior bore terminating in openings, and means for delivering fuel to said internal bore for ejection to the interior of the induction tube downstream of said throttle valve.

11. A fuel injection system as defined by claim 10, wherein said openings are located in the region adjacent an edge of said throttle valve.

12. A fuel injection system as defined by claim 10, wherein said throttle valve is provided with transverse bores communicating with said interior channel.

13. A fuel injection system as defined by claim 1, the improvement comprising at least one branch tubulation originating in said induction tube and terminating in said induction tube in the vicinity of the inlet valves of the engine.

14. A fuel injection system as defined by claim 13, wherein said at least one branch tubulation originates in said induction tube at a location lying between said air flap and said throttle valve and includes a secondary throttle flap which is actuated in common with the main throttle flap; whereby a fixed ratio of air flow rate is defined in said main induction tube with respect to said branch tubulation.

* * * * *